US005680733A

United States Patent [19]

Mitani

[11] Patent Number: 5,680,733

[45] Date of Patent: Oct. 28, 1997

[54] SUPPORT BODY FOR OUTDOOR EQUIPMENT

[75] Inventor: Motoi Mitani, Yokohama, Japan

[73] Assignee: A and E Co., Ltd., Kanagawa, Japan

[21] Appl. No.: 256,435

[22] PCT Filed: Nov. 18, 1993

[86] PCT No.: PCT/JP93/01694

§ 371 Date: Jul. 5, 1994

§ 102(e) Date: Jul. 5, 1994

[87] PCT Pub. No.: WO94/11668

PCT Pub. Date: May 26, 1994

[30] Foreign Application Priority Data

Nov. 19, 1992 [JP] Japan ..... 4-090166
Aug. 24, 1993 [JP] Japan ..... 5-229645

[51] Int. Cl.[6] ..... E01F 9/016

[52] U.S. Cl. ..... 52/169.13; 52/295; 52/296; 52/713; 52/731.1; 52/731.4; 40/606; 248/300; 256/DIG. 5; 297/452.39; 362/145; 362/152

[58] Field of Search ..... 52/731.1, 295, 52/712, 713, 296, 297, 731.4, 169.9, 169.13, 170; 248/300, 679, 247; 362/147, 145, 152, 153, 153.1; 40/606, 612; 256/DIG. 5, 59, 64, 65; 297/440.14, 440.1, 445.1, 449.1, 452.39

[56] References Cited

U.S. PATENT DOCUMENTS

| | | | |
|---|---|---|---|
| 67,446 | 8/1867 | Oliver | 52/296 |
| 250,933 | 12/1881 | McLean | 52/721.2 |
| 296,796 | 4/1884 | Sweeney et al. | 52/296 X |
| 420,537 | 2/1890 | Harrison | 52/297 X |
| 575,035 | 1/1897 | Marble | 52/295 |
| 677,090 | 6/1901 | Lanz | 52/170 |
| 864,854 | 9/1907 | Murray | 52/295 |
| 879,629 | 2/1908 | Gray | 52/721.2 X |
| 887,217 | 5/1908 | Oliphant | 52/295 |
| 1,142,321 | 6/1915 | Grandjean | 52/295 |
| 1,409,089 | 3/1922 | Fitch | 52/296 X |
| 1,630,804 | 5/1927 | Scholes | 52/295 X |
| 1,946,049 | 2/1934 | Weiskopf et al. | 52/731.4 X |
| 2,130,000 | 9/1938 | Fay | 248/300 X |
| 2,162,302 | 6/1939 | Greene | 362/153.1 |
| 2,164,428 | 7/1939 | Rhodes | 52/295 |
| 2,588,631 | 3/1952 | James | 248/300 X |
| 2,669,434 | 2/1954 | White | 256/59 |
| 3,330,087 | 7/1967 | Troutner | 52/731.1 X |
| 3,544,782 | 12/1970 | Hahn | 362/152 |
| 3,663,808 | 5/1972 | Baatz | 362/152 |
| 4,199,908 | 4/1980 | Teeters | 52/295 |
| 4,218,859 | 8/1980 | Sams | 52/295 X |
| 4,329,826 | 5/1982 | Flogaus et al. | 52/712 |
| 4,386,762 | 6/1983 | Collins | 256/DIG. 5 X |
| 4,426,114 | 1/1984 | Kehl et al. | 297/445.1 X |
| 4,720,947 | 1/1988 | Yacaboni | 52/295 X |
| 5,160,202 | 11/1992 | Légarë | 362/145 X |
| 5,375,384 | 12/1994 | Wolfson | 52/297 X |

FOREIGN PATENT DOCUMENTS

| | | | |
|---|---|---|---|
| 403620 | of 1909 | France | 52/295 |
| 408090 | 3/1910 | France | 52/295 |
| 371044 | 5/1939 | Italy | 40/612 |
| 50-74732 | 6/1975 | Japan . | |
| 56-167375 | 12/1981 | Japan . | |
| 62-16107 | 1/1987 | Japan . | |
| 62-652 | 1/1987 | Japan . | |
| 62-133849 | 8/1987 | Japan . | |
| 62-148610 | 9/1987 | Japan . | |

*Primary Examiner*—Carl D. Friedman
*Assistant Examiner*—Laura A. Saladino
*Attorney, Agent, or Firm*—Flynn, Thiel, Boutell & Tanis, P.C.

[57] ABSTRACT

In outdoor equipment having at least one supporting body (S) for mounting the outdoor equipment body thereon and for fixing the same to the surface of the ground, a floor or wall, it is characterized in that the supporting body (S) is composed of a plurality of body plates (1) which have been machined beforehand in given shapes, and mounting plates (3) which are fixed to the body plates (1) by way of bolts (4) and to the outdoor equipment body, the wall or the ground. As a result, it is possible to provide outdoor equipment which is improved in the problems of maintenance, manufacturing labor, product accuracy, moving and exchanging.

5 Claims, 7 Drawing Sheets

SUPPORT BODY FOR OUTDOOR EQUIPMENT

TECHNICAL FIELD

The present invention relates to the improvement of outdoor equipment (benches, trash baskets, ashtrays, road-crossing prevention fences, bumping posts, handrails, tree protectors, bus shelters, illumination and signboards), more in detail to the improvement of outdoor equipment by employing at least one supporting body made of a combination of plates which support the outdoor equipment and moreover are made of selected materials.

BACKGROUND TECHNOLOGY

Parks, public plazas, bus terminals, rotaries and other public facilities such as playgrounds are usually provided with benches, trash baskets, ashtrays, road-crossing prevention fences, bumping posts, handrails, tree protectors, bus shelters, illumination, signboards etc. (hereinafter referred to as outdoor equipment). Such outdoor equipment is provided not only in public facilities, but also, for example, in plazas on the rooftops of department stores or supermarkets or on the ground.

Conventional outdoor equipment is usually made by artisans following the steps of assembling steel materials which have been beforehand machined in a given shape and connecting the same to one another by way of welding.

The well-known conventional outdoor equipment, however, has the following drawbacks.

Firstly, artisans assemble the steel materials and connect the same to one another by way of welding so that the finish of products depends on the artisan's skill or dexterity and consequently products vary widely in quality.

Secondly, the ratio of the artisan's wage to the product cost is very large, particularly in case of products of elaborate design.

From a viewpoint of maintenance, coating applied to the steel materials of the conventional products is liable to be injured and moreover the coating is not stable for a long time of period, so that much maintenance cost against scratch or rust is required.

In addition to such usual maintenance, the outdoor equipment is liable to be broken when a traveling vehicle runs against or scrapes it so that it has to be exchanged with a new one in such a case. Such an exchange is required also in case of breakage due to deviltry. Moreover, there is a case in which the outdoor equipment has to be moved to the other place due to the reform of the site.

Conventional fixed type outdoor equipment requires much time and trouble for exchange or movement since the outdoor equipment is attached to bolts projecting from the foundation by way of mounting plates fixed to the outdoor equipment and thereafter is fixed thereto by way of back-filling with concrete.

DISCLOSURE OF THE INVENTION

The present invention has been made by improving the conventional outdoor equipment with regard to the problems thereof in maintenance, manufacturing trouble, product accuracy and moving or exchanging.

Outdoor equipment according to the present invention having a supporting body for mounting the outdoor equipment body thereon or for fixing the same to the surface of the ground, a floor or wall, is characterized in that the supporting body is composed of a plurality of body plates which have been beforehand machined in given shapes, and mounting plates which are fixed to the body plates by way of bolts (rivets or screws) and to the outdoor equipment body, the wall or the ground.

BEST MODE FOR CARRYING OUT THE INVENTION

The embodiments of the present invention will be described hereinafter with reference to drawings.

The outdoor equipment can be classified into a fixed type and a standing type.

The fixed type outdoor equipment is fixed on a fixed structure, such as the ground, a floor or wall to be unmovable. For example, in case the outdoor equipment is a bench, the seat plate and backrest plate are mounted on a supporting body or support body, and the supporting body is further fixed to the surface of the ground, a floor or wall. In case the outdoor equipment is a trash basket, the trash basket is attached to the supporting body and the supporting body is further fixed to the surface of the ground, the floor or the wall.

The standing type outdoor equipment is put on the ground or a floor to be movable. For example, in case the outdoor equipment is a bench, the seat plate and backrest plate are mounted on a supporting body, and the supporting body is further put on the surface of the ground, a floor or wall. In case the outdoor equipment is a trash basket, the trash basket is attached to the supporting body and the supporting body is further put on the surface of the ground, the floor or the wall. That is, in case the outdoor equipment is a bench or a trash basket, the supporting body serves as a leg portion thereof.

Likewise, in case the outdoor equipment is a fence, a bumping post, a handrail, a tree protector, a bus shelter, illumination or a signboard, the supporting body is attached to a road-crossing prevention fence, a bumping post member, a handrail, a tree protector ring, partition members, an illumination member or a signboard plate respectively.

The plates for the bench, the trash basket, the bumping post member, the handrail, the tree protector ring, the partitioning member, the illumination member, the signboard plate etc. are generally called as outdoor equipment body in this description.

Figure 1:
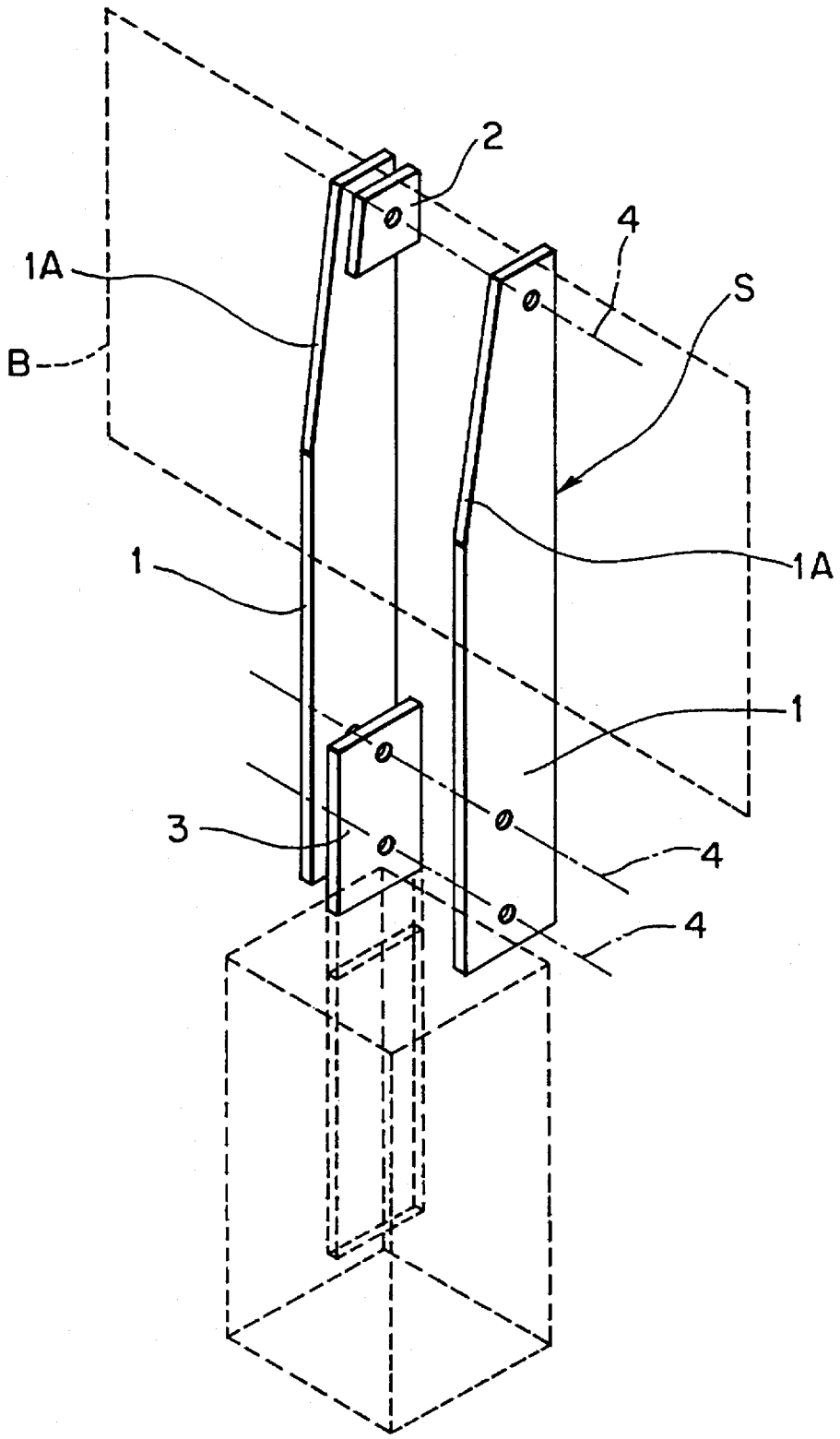
FIG. 1 is a perspective view of a supporting body according to a first embodiment of the present invention.

FIG. 1 is an exploded perspective view showing the structure of a supporting body according to a first embodiment of the present invention. This is a fixed type outdoor equipment for supporting a signboard.

Referring to the figure, body plates 1 which have been beforehand cut in a designed shape is fixedly mounted on a mounting plate 3 by way of bolts 4 (including rivets or screws). In the embodiment illustrated in the figure, two body plates 1 are provided in such a way as to sandwich the mounting plate 3 therebetween to thereby fix the two body plates 1 to the mounting plate 3 while a spacer plate 2 is placed between the body plates 1 to thereby fix the same to each other. The spacer plate 2 adjusts the distance between the body plates 1. The mounting plate 3 is fixed to a foundation which is buried in the ground. A signboard B which is illustrated by a broken line in the figure is attached to the obliquely cut portions 1A of the body plates 1 by way of mounting plates or other arbitrary mounting means.

The body plates 1, the spacer plate 2 (dispensable when occasion demands) and the mounting plate 3 constitutes a supporting body S for supporting the signboard B.

The supporting body S can also employ a high-strength steel bolt depending on a load applied thereto in this embodiment.

Moreover, more than two body plates 1 can be attached to the mounting plate 3 too. In this case the spacer plate 2 is desirable to be sandwiched between the pairs of adjacent body plates 1 but it is not indispensable.

It is also possible to support a signboard B by two or more supporting bodies S according to the invention.

Although the outdoor equipment is a fixed type one according to the first embodiment illustrated in FIG. 1, the supporting body of the invention is also applicable to a standing type outdoor equipment.

Figure 2:
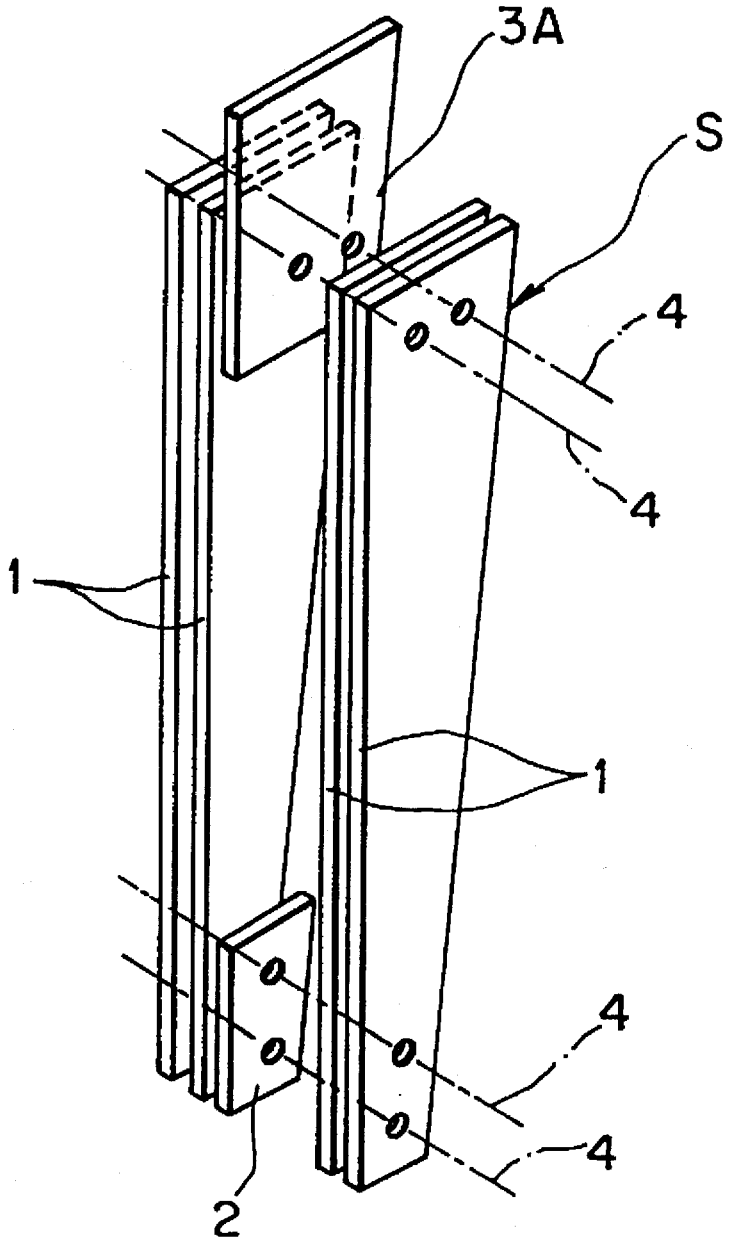
FIG. 2 is a perspective view of a supporting body employing a plurality of plates according to a modified first embodiment of the present invention.

FIG. 2 is a perspective view showing a supporting body S provided in a standing type outdoor equipment according to a modified first embodiment of the present invention, the supporting body S being used as the leg portion of a bench or a trash basket.

The supporting body S has a structure in which two pairs of body plates 1 sandwich a mounting plate 3A therebetween at the portions adjacent to the upper ends thereof and bolts 4 fix them to one another. Also in this embodiment, it is possible to provide the spacer plate 2 between the two pairs of adjacent body plates 1 and bolts 4 for fixing them to one another so as to eliminate any gap therebetween.

A outdoor equipment, not shown, is attached to the mounting plate 3A.

As understood from the figure, the supporting body S is composed of the body plates 1, the mounting plate 3A and the spacer plate 2 (this spacer plate 2 is dispensable) according to this embodiment.

The spacer plate 2 serves also as a leg member when it is provided in such a way as to project from the lower ends of the body plates 1.

Figure 3:
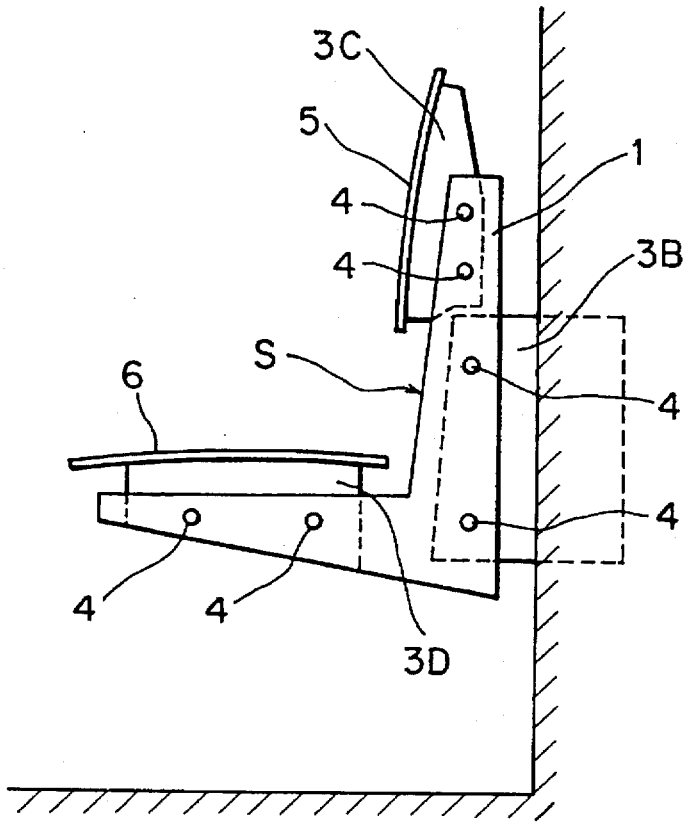
FIG. 3 is a side view of a bench which is fixed to the surface of a wall by way of the supporting bodies according to a second embodiment of the present invention.
Figure 4:
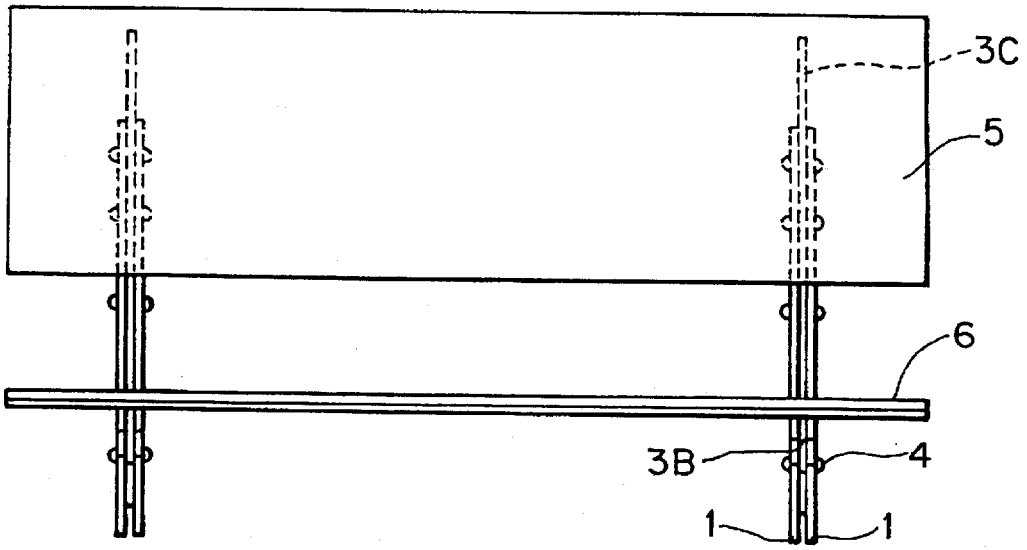
FIG. 4 is a front view of the bench in FIG. 3.

FIGS. 3 and 4 show a bench fixed on a wall according to a second embodiment of the present invention.

Referring to the figure, L-shaped body plates 1 are fixed to the projecting portions of a wall mounting plates 3B which are buried in or attached to the surface of a wall by way of bolts 4. According to this embodiment a pair of body plates 1 are fixed to each wall mounting plate 3B in such a way as to sandwich the same therebetween. A backrest plate 5 is attached to the body plates 1 adjacent to the upper end thereof by way of mounting plates 3C. Likewise a seat plate 6 is attached to the forward projecting portions of the body plates 1 by way of seat plate mounting plates 3D.

As understood from the figure, the supporting body S is composed of the body plates 1, the mounting plates 3C, the wall mounting plates 3B and the seat plate mounting plates 3D in this embodiment.

Wherein the number of the body plates 1 is not limited to 2 as illustrated in the figure, but can be more than that depending on the strength thereof.

It is also possible to provide a spacer plate between adjacent body plates 1.

Figure 5:
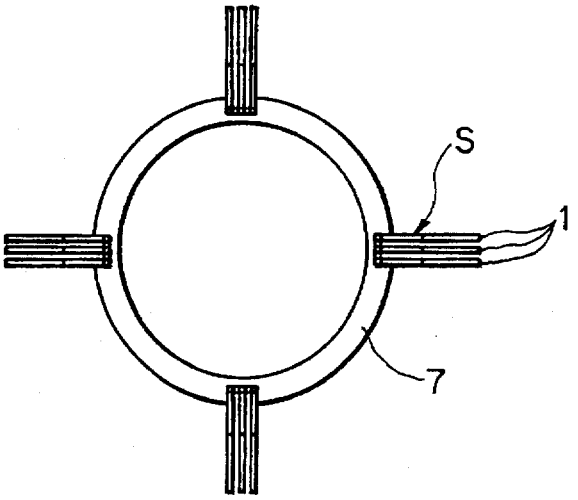
FIG. 5 is a plan view exemplifying a tree protector (a support for a roadside tree) employing the supporting body according to a third embodiment of the present invention.
Figure 6:
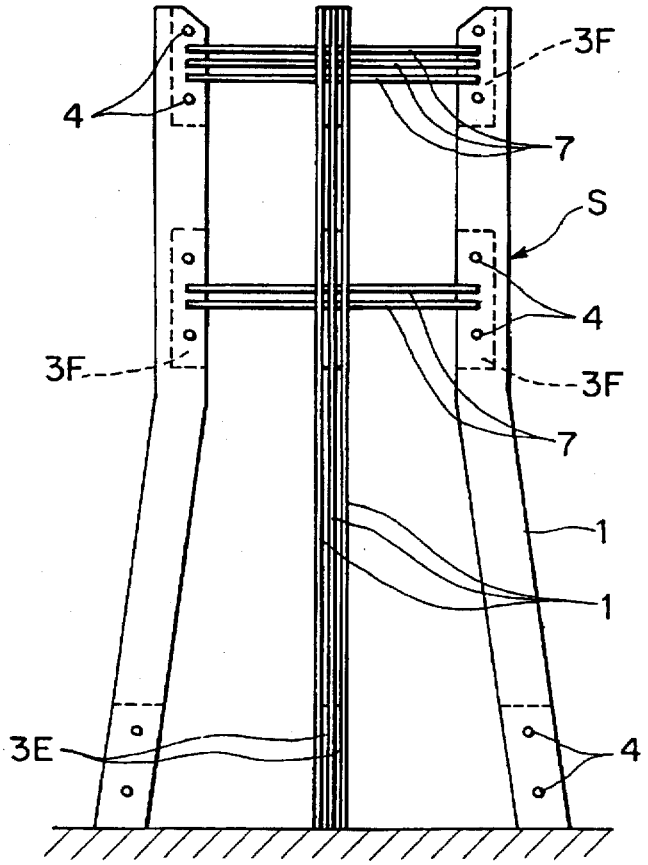
FIG. 6 is a front view of the tree protector in FIG. 5.

A tree protector according to a third embodiment of the invention will be described hereinafter with reference to FIGS. 5 and 6.

The tree protector surrounds a tree for preventing it from falling or from being injured.

Referring to the figures, foot mounting plates 3E fixed in the ground are arranged on a circumference at an interval of 90° each in a pair. The interval is not limited to 90° but can be selected properly, e.g., 120° or 72°. The number of foot mounting plates 3E which are buried together at a point is not limited to two but can be more than that. Three body plates 1 are fixed to two foot mounting plates 3E by way of bolts 4 respectively. Each body plate 1 has a shape of long plate extending upward. Vertical ring mounting plates 3F are fixed to supporting rings 7 each having a shape of discoidal ring, the ring mounting plates 3F being sandwiched by adjacent body plates 1. The ring mounting plates 3F and the body plates 1 are fixed to one another by way of bolts 4.

The supporting rings 7 can be provided at vertically different positions properly in number, and the number of the supporting rings 7 is not limited to that of this embodiment in the present invention.

Since the supporting rings 7 are installed around a tree, each of them is designed to be divided into two or more circular arc portions for surrounding the tree in installation. The circular arc portions are connected to one another after they are installed around the tree.

As understood from the figures, the supporting body S is composed of the body plates 1, the foot mounting plates 3E and the ring mounting plates 3F according to this embodiment, and the supporting body S further comprises spacer plates in case the supporting body S employs a structure in which the body plates 1 sandwich the spacer plates therebetween.

Figure 7:
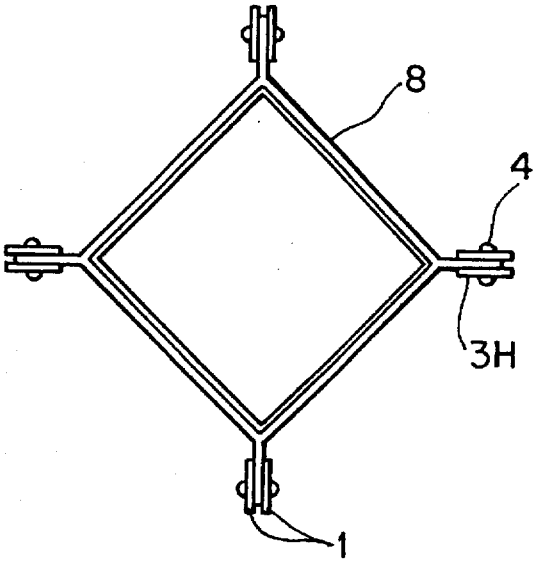
FIG. 7 is a plan view exemplifying a trash basket employing the supporting body according to a fourth embodiment of present invention.
Figure 8:
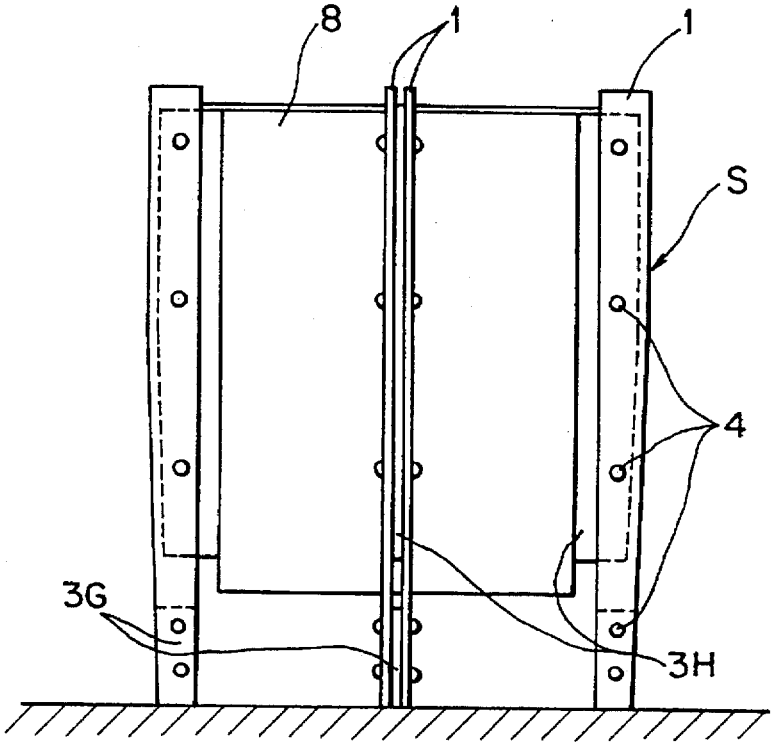
FIG. 8 is a front view of the trash basket in FIG. 7.

A trash basket according to a fourth embodiment of the present invention will be described hereinafter with reference to FIGS. 7 and 8.

Each foot mounting plates 3G fixed in the ground is arranged on a circumference at an interval of 90° according to this embodiment. The interval is not limited to 90° but may be selected properly, e.g., 120° or 72°. The number of foot mounting plates 3G which are buried together at a point is not limited to two but can be more than that. Two body plates 1 are fixed to a foot mounting plate 3G by way of bolts 4 respectively. Each body plate 1 has a shape of long plate extending upward. The basket has a square shape in plan view and comprises basket mounting plates 3H each extending outwards from each edge of the square, the basket mounting plates 3H being provided with the basket integrally therewith or separately therefrom. Each basket mounting plate 3H is sandwiched by adjacent body plates 1 and is fixed thereto by way of the bolts 4.

As understood from the figures, the supporting body S is composed of the body plates 1, the foot mounting plates 3G and the basket mounting plates 3H according to this embodiment, and the supporting body S further comprises spacer plates in case the supporting body S employs a structure in which the body plates 1 sandwich the spacer plates therebetween.

It is also possible to omit the foot mounting plates 3G to make a standing type trash basket in the embodiment set forth above. In that case it is preferable to provide spacer plates instead of the foot mounting plates.

As described above, the present invention is characterized in that mounting plates extending from the outdoor equipment body or from the fixing side (the surface of the ground, a floor or wall) are fixed to the body plates 1 by way of bolts, and moreover spacer plates are provided between adjacent body plates if needs be. The outdoor equipment body is not limited to that in the embodiments set forth above in the present invention.

Also with regard to locking means, it is not limited to the bolts, but includes rivets, screws and other locking metal parts.

Furthermore, the materials of the outdoor equipment, the mounting plates thereof, the body plates and spacer plates are not specified particularly, but include metals (weather corrosion resistant metals are particularly preferable, but are not indispensable), precast reinforced concrete, ceramics including glass, stone etc. In case of metal materials, corrosion resistant metals such as aluminum, stainless steel etc. or weather corrosion resistant steel of medium thickness (6 to 16 mm thick) are more effective.

FIG. 9 shows various combinations of the body plates 1 and the spacer plates constituting the supporting body S according to the present invention.

Figure 9A:
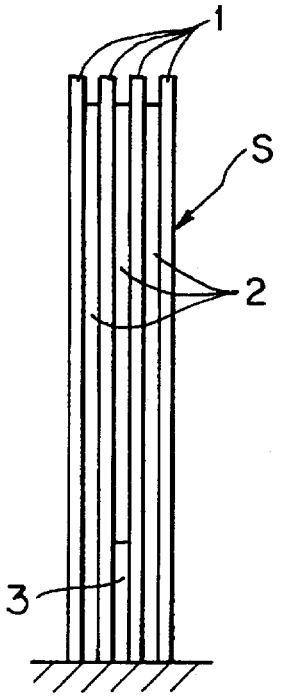
FIG. 9(A) to FIG. 9(E)are front views showing various combinations of the body plates and spacer plates in the supporting body according to the present invention.

FIG. 9(A) shows a combination of the body plates 1 of metal and the spacer plate 2 of metal for constituting the supporting body S.

Figure 9B:
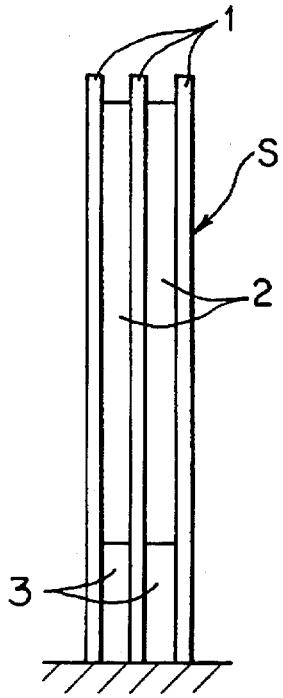

FIG. 9(B) shows a combination of the body plates 1 of metal and the spacer plate 2 of stone for constituting the supporting body S.

Figure 9C:
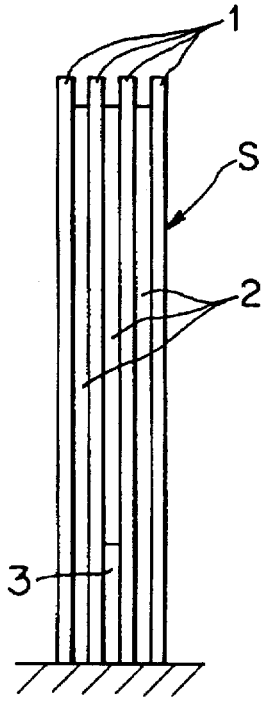

FIG. 9(C) shows a combination of the body plates 1 of metal and the spacer plate 2 of ceramics (including glass) for constituting the supporting body S.

Figure 9D:
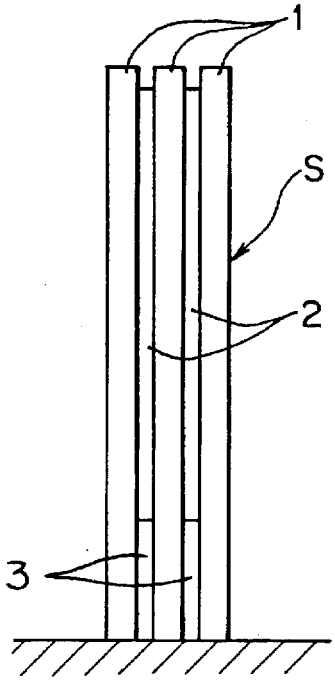

FIG. 9(D) shows a combination of the body plates 1 of stone and the spacer plate 2 of ceramics (including glass) for constituting the supporting body S.

Figure 9E:
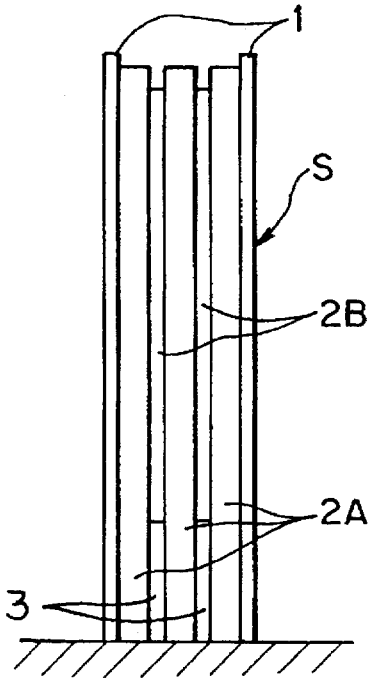

FIG. 9(E) shows a combination of the body plates 1 of metal, the spacer plate 2A of stone and the spacer plate 2B of ceramics (including glass) for constituting the supporting body S. In this combination, the spacer plates 2A and the spacer plates 2B are arranged alternately.

Figure 10:
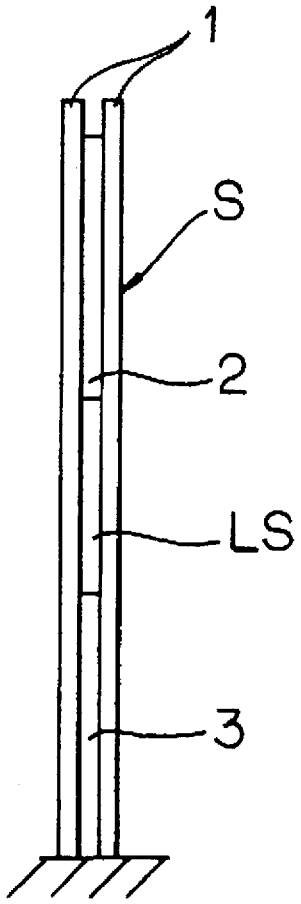
FIG. 10 is a front view illustrating a light source in the supporting body.

Among the combinations illustrated in FIG. 9, it is also possible to provide a light source LS in the supporting body S for illumination in case spacer plates of a translucent glass are employed as illustrated in FIG. 10.

If the body plates are machined by a laser cutter controlled by a computer, they can be cut in freely selected shapes so that they can be of elaborate shape in design, and moreover it is possible to provide the products of high accuracy in large quantities, in short time and at low cost.

The effect of the thus arranged outdoor equipment according to the present invention will be described hereinafter.

Since the supporting body composed of plates is employed, it is easy in assembling, disassembling and removal, and also in moving and exchanging.

If welding is employed for fixing, available materials are limited to steel excluding some non-rusting metals such as aluminum (or some weather corrosion resistant steel products which are stable against rust), but bolts (or rivets or screws) are employed for fixing the plates according to the present invention, so that the available materials are not limited to steel and consequently coating can be omitted. Moreover, since materials other than steel can be used, it has an advantage that rust-resistant or scratch-resistant materials are also available.

Various structures of the supporting body can be obtained by properly selecting the materials of the body plate and the spacer plate.

In case glass is employed as the material of the spacer plate, it is possible to achieve an illumination effect by providing a light source inside the supporting body, and moreover use it as a luminous supporting body.

If the supporting body is machined by a laser cutter controlled by a computer, the products of high accuracy can be manufactured in large quantities and at low cost even if it is of elaborate design.

I claim:

1. A support body for mounting to an equipment body comprising:

an equipment body;

a plurality of body plates having a predetermined shape, said plurality of body plates being made of a rigid material and adapted to support vertical and horizontal loads being applied to said support body;

at least one mounting plate disposed between a pair of said body plates, said mounting plate being fixed to said body plates by at least one fastener and including a fixing portion which is fixed to said equipment body such that said loads applied to said support body are supported by said body plates; and at least one spacer plate disposed between said pair of said body plates, said at least one spacer plate being made of a glass material and said support body including at least one light source therein.

2. A support body mounted to a base surface comprising:

a plurality of body plates having a predetermined shape, said plurality of body plates being made of a rigid material and adapted to support vertical and horizontal loads being applied to said support body;

at least one mounting plate disposed between a pair of said body plates, said mounting plate being fixed to said body plates by at least one fastener and including a fixing portion which is fixed to said base surface; and at least one spacer plate disposed between said pair of said body plates, said spacer plate being translucent and a light source being sandwiched between said body plates in a region proximate said spacer plate.

3. A support body mounted to a fixed structure comprising:

at least one mounting plate including mounting means at one end thereof connected to said fixed structure and a planar plate portion projecting a predetermined distance away from said mounting means and said fixed structure;

at least a pair of body plates spaced apart one from the other and having said planar plate portion sandwiched therebetween connected to the fixed structure, said planar plate fixed between said pair of body plates by at least one fastener connected between said body plates and said mounting plate in secure engagement therewith, said mounting means projecting from the space between said body plates, said body plates being a rigid material and being adapted to support vertical and horizontal loads being applied to said support body; and at least one first plate disposed between said body plates in a sandwiched relation, said first plate being fixed between said pair of body plates by fastening means, a first equipment body portion of an equipment body being fixedly secured to said first plate such that said loads are applied to said equipment body and are supported by said body plates, a second plate being fixedly secured between said body plates by fastening means in a sandwiched relation, said second plate being fixedly secured to a second equipment body portion so as to be supported by said body plates.

4. The support body according to claim 3, wherein said body plates extend a predetermined distance which corresponds substantially to at least one of a horizontal and vertical dimension of said equipment body.

5. A support body mounted to a fixed structure comprising:

at least one mounting plate including mounting means at one end thereof connected to said fixed structure and a planar plate portion projecting a predetermined distance away from said mounting means and said fixed structure;

at least a pair of body plates spaced apart one from the other and having said planar plate portion sandwiched therebetween connected to the fixed structure, said planar plate portion fixed between said pair of body plates by at least one fastener connected between said body plates and said mounting plate in secure engagement therewith, said mounting means projecting from the space between said body plates, said body plates being a rigid material and being adapted to support vertical and horizontal loads being applied to said support body; and at least one first plate disposed between said body plates in a sandwiched relation, said first plate being fixed between said pair of body plates by fastening means, said first plate being translucent and a light source being sandwiched between said body plates in a region proximate said first plate.

* * * * *

UNITED STATES PATENT AND TRADEMARK OFFICE

CERTIFICATE OF CORRECTION

PATENT NO. : 5 680 733

DATED : October 28, 1997

INVENTOR(S) : Motoi Mitani

It is certified that error appears in the above-indentified patent and that said Letters Patent is hereby corrected as shown below:

Column 6, line 64; change "connected" to
---for said connection---.

Column 8, line 6; change "connected" to
---for said connection---.

Signed and Sealed this

Second Day of June, 1998

*Attest:*

*Attesting Officer*

BRUCE LEHMAN

*Commissioner of Patents and Trademarks*